US007781657B2

(12) United States Patent
Nickel

(10) Patent No.: US 7,781,657 B2
(45) Date of Patent: Aug. 24, 2010

(54) RESONATING CHAMBER FOR DEVICES INCLUDING MUSICAL INSTRUMENTS

(76) Inventor: Greg Nickel, 1107 Elliot Ave. West, Seattle, WA (US) 98119

( * ) Notice: Subject to any disclaimer, the term of this patent is extended or adjusted under 35 U.S.C. 154(b) by 962 days.

(21) Appl. No.: 11/333,872

(22) Filed: Jan. 17, 2006

(65) Prior Publication Data

US 2006/0156898 A1 Jul. 20, 2006

Related U.S. Application Data

(60) Provisional application No. 60/644,200, filed on Jan. 15, 2005, provisional application No. 60/644,201, filed on Jan. 15, 2005, provisional application No. 60/644,202, filed on Jan. 15, 2005.

(51) Int. Cl.
*G10D 13/02* (2006.01)

(52) U.S. Cl. ..... 84/411 R

(58) Field of Classification Search ..... 84/411 R
See application file for complete search history.

(56) References Cited

U.S. PATENT DOCUMENTS

| | | | | |
|---|---|---|---|---|
| 755,610 | A | 3/1904 | Bower | |
| 2,024,937 | A | 12/1935 | Ludwig | |
| 2,096,209 | A | 10/1937 | Strupe | |
| 2,101,784 | A | 12/1937 | Logan | |
| 2,517,124 | A | 8/1950 | Ludwig et al. | |
| 2,666,922 | A | 1/1954 | Torricelli | |
| 4,018,130 | A | 4/1977 | Gariepy, Sr. et al. | |
| 4,339,982 | A | 7/1982 | Hoshino et al. | |
| 4,967,634 | A | 11/1990 | Whynott et al. | |
| 5,031,499 | A * | 7/1991 | Wang | 84/411 M |
| 5,204,484 | A | 4/1993 | Netto et al. | |
| 5,419,230 | A | 5/1995 | Ocheltree et al. | |
| 5,507,214 | A | 4/1996 | Hoshino et al. | |
| 5,557,053 | A | 9/1996 | Nickel | |
| 5,616,875 | A | 4/1997 | Lombardi | |
| 5,785,479 | A | 7/1998 | Battisti et al. | |
| 5,955,183 | A | 9/1999 | Braun | |
| 6,093,877 | A | 7/2000 | Nickel | |
| 6,215,053 | B1 | 4/2001 | Adinolfi | |
| 6,700,046 | B2 | 3/2004 | Cherbettchian et al. | |
| 6,739,626 | B2 | 5/2004 | Mori et al. | |
| 6,846,978 | B2 | 1/2005 | Dorfman et al. | |

(Continued)

OTHER PUBLICATIONS

U.S. Appl. No. 11/333,894, Nickel.
Dunnett, Ronn. "Snare Beds" *Drumdojo*. www.drumdojo.com/tech/snarebed.htm, accessed Jan. 6, 2006, 3 pages.
Artus Corporation; "Artus—History;" <http://www.artuscorp.com/artus_history.htm> [accessed Aug. 15, 2008] ; 1 page.
Artus Corporation; "Artus—Shim Stock;" <http://www.artuscorp.com/shim_stock.htm> [accessed Aug. 15, 2008] ; 3 pages.

*Primary Examiner*—Kimberly R Lockett
(74) *Attorney, Agent, or Firm*—Perkins Coie LLP

(57) ABSTRACT

A resonating device is disclosed. The device can include a generally planar first portion, a second portion opposite the first portion, and a body portion. The body portion generally has a first stiffness and includes a discontinuity with a second stiffness that is less than the first stiffness. The discontinuity is positioned to allow the body portion to circumferentially vibrate relative to the discontinuity.

11 Claims, 9 Drawing Sheets

U.S. PATENT DOCUMENTS

| | | | | |
|---|---|---|---|---|
| 6,849,793 | B2 | 2/2005 | Okamoto et al. | |
| 6,867,355 | B2 | 3/2005 | Okamoto et al. | |
| 6,891,098 | B1 | 5/2005 | Lombardi | |
| 6,942,441 | B1 | 9/2005 | Lathrop | |
| 6,958,440 | B2 | 10/2005 | Yu-Hwa et al. | |
| 7,202,405 | B2 | 4/2007 | Takegawa et al. | |
| 7,301,087 | B2 * | 11/2007 | Takegawa | 84/411 R |
| 2002/0029680 | A1 * | 3/2002 | Cleland | 84/411 R |
| 2004/0031375 | A1 | 2/2004 | Hayden | |
| 2006/0156899 | A1 * | 7/2006 | Nickel | 84/415 |

* cited by examiner

RESONATING CHAMBER FOR DEVICES INCLUDING MUSICAL INSTRUMENTS

CROSS-REFERENCE TO RELATED APPLICATIONS

The present application claims the benefit of U.S. Provisional Application Nos. 60/644,200, 60/644,201, and 60/644,202, all of which were filed on Jan. 15, 2005, and all of which are incorporated herein by reference.

TECHNICAL FIELD

The present invention relates generally to an improved resonating chamber. The apparatus described below has particular utility in connection with improving the spectrum of sound produced by, for example, drums, guitars, speakers, or any instrument that can project, transmit, or enhance sound.

BACKGROUND

An instrument used for projecting, transmitting, and/or enhancing sound typically includes a solid body with a hollow cavity and a resonating element, such as a membrane, a string, or a diaphragm. For example, a drum can be made with an animal skin stretched over an open end of a hollow body. When a user strikes the resonating element, the vibration of the resonating element produces a sound that is characteristic of the instrument. Many factors can influence the sound produced. These factors include, for example, the types of materials used for the body and for the resonating element, the shape of the body, and the addition of other components. For example, a snare can be added to the membrane or the body of a drum to further enhance the sound. Typically, a user can tune the instrument by adjusting the tension applied to the resonating element. However, the tuning range is rather limited. Furthermore, the ability of the instrument body to project, transmit, and/or enhance sound is rather limited due to the destructive interference of sound waves carried by the instrument body. Accordingly, there is a need for improving the tunable range of the instrument and the ability of the instrument body to project, transmit, and/or enhance sound.

DETAILED DESCRIPTION

A. Overview

Figure 1A:
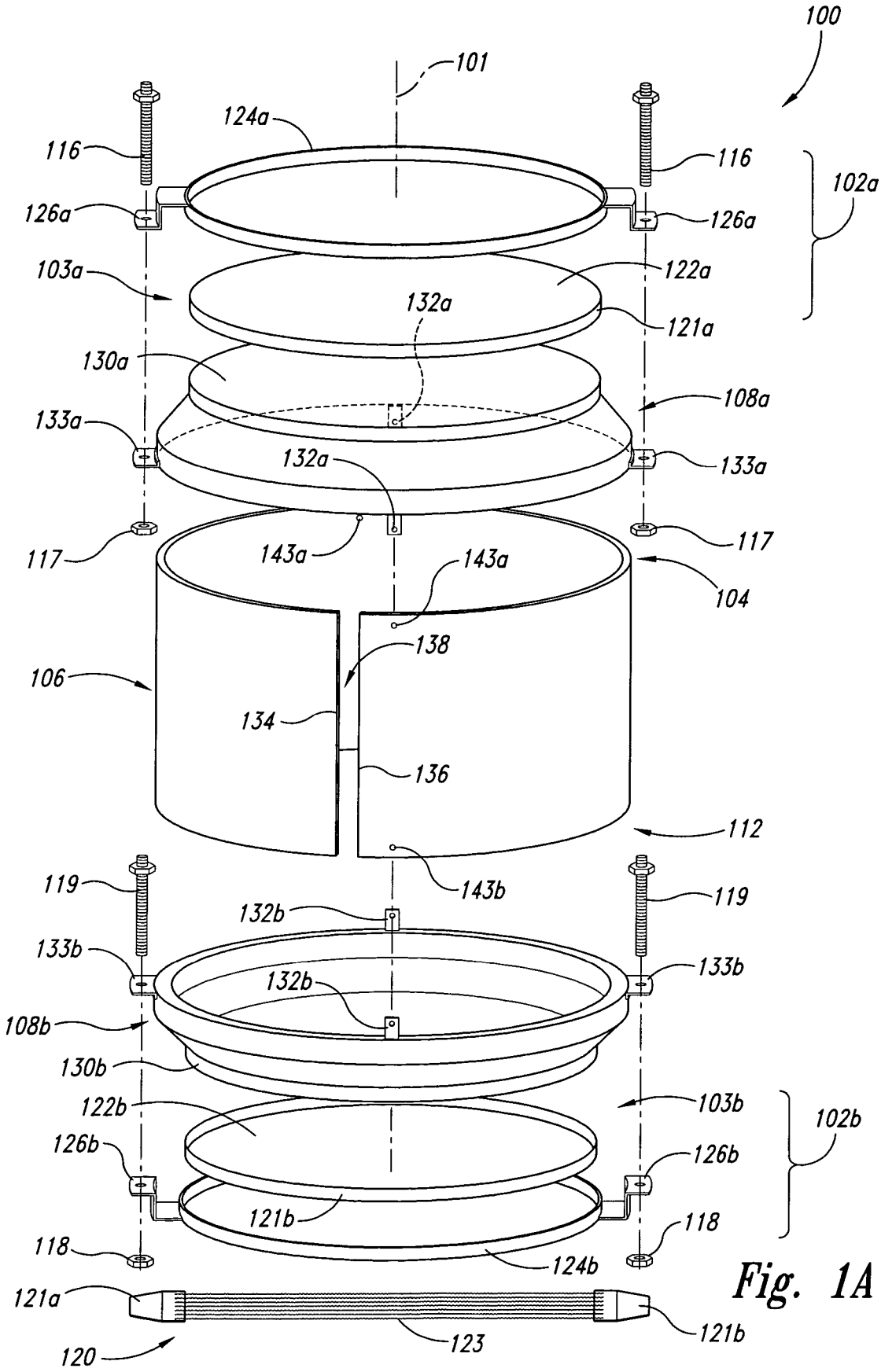
FIG. 1A is an isometric view of a resonating device configured in accordance with an embodiment of the invention.

The present disclosure describes resonating devices having superior tuning ranges and enhanced abilities to project, transmit, and enhance sound. Aspects of the invention are described below in the context of a drum for producing sound. It should be understood that in other embodiments, the resonating devices can include speakers, guitars, microphones or any other devices having a resonating cavity coupled with a resonating element, such as a membrane, a string, a diaphragm, or any other elements capable of producing pulsating air pressures. It will be appreciated that several of the details set forth below are provided to describe the following embodiments in a manner sufficient to enable a person skilled in the relevant art to make and use the disclosed embodiments. Several of the details and advantages described below, however, may not be necessary to practice certain embodiments of the invention. Additionally, the invention can include other embodiments that are within the scope of the claims but are not described in detail with respect to FIGS. 1A-5B.

One aspect of the disclosed embodiments is directed toward a resonating device (e.g., a drum for producing sound) that includes a generally planar first portion with a resonating element (e.g., a membrane), a generally planar second portion opposite and generally parallel to the first portion, and a generally cylindrical body portion between the first portion and the second portion. The body portion generally has a first stiffness and a discontinuity with a second stiffness that is less than the first stiffness. The discontinuity can be positioned to allow the body portion to circumferentially vibrate relative to the discontinuity. In further aspects, the body portion can be arranged about an axis extending between the first and second portions. The body portion can include a separation portion generally parallel to the axis, and the discontinuity can be located at and aligned along the separation portion.

Another aspect is directed toward a resonating device (e.g., a drum for producing sound) including a first portion with a resonating element (e.g., a membrane), a second portion opposite and generally parallel to the first portion, and a body portion having a surface. The surface can be positioned between the first portion and the second portion to enclose a resonating chamber volume. The surface can further include a circumferential opening extending partially around the circumference of the surface. The circumferential opening can include, for example, a slot or a plurality of perforations. In other aspects, the circumferential opening can include a plurality of opening sections, which can have equal lengths and can be evenly spaced.

Another aspect is directed toward a resonating device assembly (e.g., a drum assembly) for producing sound. The device assembly can include a first portion having a resonating element (e.g., a drum head having a membrane), a body portion having first and second ends, and a coupler between the first portion and the first end of the body portion. The coupler can be attached to the body portion and can have an edge bearing against the resonating element. The coupler can be positioned to allow the resonating element to vibrate relative to the body portion. In further aspects, the coupler can include a plurality of attachment elements (e.g., brackets) spaced apart from each other. The plurality of attachment elements can be attached to a plurality of corresponding locations at the first end of the body portion.

Another aspect is directed toward a drum that has a resonating chamber with a first end, a second end, and a shell between the first and second ends. The shell has a first aperture. The apparatus can also include a bracket proximate to the shell and having a second aperture corresponding to the first aperture. The apparatus can further include a vibration isolator between the bracket and the shell and a fastener extending through the first and second apertures and the vibration isolator. In one example, the vibration isolator can include a plurality of vibration isolator elements, such as springs or flexible tape portions.

Another aspect is directed toward a musical percussion instrument that includes a shell and a battered end. The shell has a first end and a second end. The battered end has a resonating element (e.g., a membrane, a string, or a diaphragm) that is placed adjacent to one of the first and second open ends of the shell. The shell can be constructed from a sheet with multiple laminated layers, at least two of which are metal layers. The multiple laminated layers can be preformed layers bonded together to form the sheet, and each layer can have a thickness of not less than 0.001 inches. A specific example of the sheet is a laminated metal sheet that includes a layer of aluminum having a thickness of 0.060 inches sandwiched between two layers of stainless steel, each of which has a thickness of 0.003 inches. In further aspects, at least one of the laminated layers can be a non-metal layer.

B. Resonating Device with Body Discontinuity

FIG. 1A is an isometric view of a resonating device in the form of a drum 100 configured in accordance with an embodiment of the invention. The drum 100 can include a first portion 102*a* connected to a first end 104 of a body portion 106 with a first coupler 108*a*, and a second portion 102*b* connected to a second end 112 of the body portion 106 with a second coupler 108*b*. Tensioning devices 116-119 can connect the first and second portions 102*a*-*b* to the body portion 106. The drum 100 can optionally include a snare 120 placed adjacent to one of the first portion 102*a* and the second portion 102*b*. Various embodiments of the body portion 106 and the couplers 108*a*-*b* are described in more detail below with reference to FIGS. 2A-3D.

The first and second portions 102*a*-*b* and the first and second couplers 108*a*-*b* can have many similar features. As such, the features of the first portion 102*a* are described below with reference symbols followed by an "a," and the corresponding features of the second portion 102*b* are shown and noted by the same reference symbol followed by a "b." In addition, like reference symbols generally refer to like features and components.

The first portion 102*a* can be configured to produce resonant vibrations when a user excites the first portion 102*a*, for example, by striking the membrane 122*a* with a stick. As such, the first portion 102*a* can also be called the battered end. The first portion 102*a* can include a drum head 103*a* having a membrane 122*a* positioned across an open surface of a cavity (e.g., the first end 104 of the body portion 106). The membrane 122*a* can be carried by a flesh hoop 121*a* to form a vibrating surface. The term "membrane" generally refers to a thin and generally planar structure that separates two volumes of space. The membrane 122*a* can be constructed from any suitable material with sufficient strength and flexibility to vibrate when excited. For example, the membrane 122*a* can be constructed from an animal skin, a synthetic material, a metal, a metal alloy, a ceramic, a fabric, or any combination of these materials. The flesh hoop 121*a* provides support for the membrane 122*a* and can be constructed from any generally rigid material including, for example, wood, plastic, metals, and/or ceramics.

The first portion 102*a* can also include a drum rim 124*a* configured to apply tension to the membrane 122*a* in conjunction with the first coupler 108*a*. The drum rim 124*a* can have a ring shape and can be appropriately sized to accommodate the drum head 103*a*. The drum rim 124*a* can be constructed from any material sufficiently rigid to impart a tension to the membrane 122*a*, for example, wood, plastic, metals, and/or ceramics. The drum rim 124*a* can include attachment members 126*a* (e.g., rim flanges) that receive or support one of the tensioning devices 116 (e.g., a bolt). The first coupler 108*a* can include corresponding attachment members 133*a* (e.g., flanges) that receive the bolt. A corresponding tensioning device 117 (e.g., a nut) can then be attached to the bolt to fasten the membrane 122*a* to the first coupler 108*a*. A user can tune the membrane 122*a* by applying different amounts of tension to the membrane 122*a* with the tensioning devices 116, 117, as described in greater detail below.

The first coupler 108*a* can include a bearing edge 130*a* facing toward the first portion 102*a* and configured to bear against the membrane 122*a*. The flesh hoop 121*a* fits around the bearing edge 130*a* so that the membrane 122*a* bears against the bearing edge 130*a*. The drum rim 124*a* can be positioned to bear down against the flesh hoop 121*a*. As such, the drum head 103*a* can be clamped between the drum rim 124*a* and the first coupler 108*a* with the tensioning devices 116, 117 extending through the attachment members 126*a* and 133*a*. As a user tightens the tensioning devices 116, 117 relative to each other, the drum rim 124*a* can be urged toward the first coupler 108*a* to clamp down on the flesh hoop 121*a* and stretch the membrane 122*a*. By adjusting the applied tension, the user can modify the resonating characteristics of the membrane 122*a* and thus tune the drum 100.

The first coupler 108*a* can also be configured to flexibly or fixedly couple the drum head 103*a* to the body portion 106. Accordingly, the first coupler 108*a* can include a plurality of spaced-apart attachment elements 132*a*. The attachment elements 132*a* can be configured to connect with a plurality of corresponding locations at the first end 104 of the body portion 106. Each attachment element 132*a* can include, for example, a bracket, a stud, a clip, a fork, or any other fixture or attachment mechanism. In one embodiment, the first coupler 108*a* can be flexibly attached to a plurality of apertures 143*a* on the side wall of the body portion 106 with a plurality of vibration isolators, as described in more detail below with reference to FIGS. 4A-4B. One expected advantage of the flexible connection is that vibrations from the drum head 103*a* can be at least partially isolated from the body portion 106. In another embodiment, the first coupler 108*a* can be fixedly attached to the apertures 143*a*, e.g. with a plurality of non-isolating bolts and nuts. In other embodiments, the first coupler 108*a* can be fixedly attached to some of the apertures 143*a* and flexibly attached to the rest of the apertures 143*a*. Accordingly, the degree to which the first coupler 108*a* transmits vibrations between the drum head 103*a* and the body portion 106 can be controlled by selecting the appropriate manner and location via which the first coupler 108*a* is attached to the body portion 106.

The body portion 106 can be configured to circumferentially resonate independently from the resonance of the membrane 122*a* of the first portion 102*a* and/or the resonance of the membrane 122*b* of the second portion 102*b*. As shown in FIG. 1A, the body portion 106 can be arranged about a body axis 101 extending between the first and second portions

102*a-b*. The body portion 106 can also include two edges 134, 136 separated by a discontinuity, e.g., a separation portion 138 that is generally parallel to the body axis 101. In some embodiments, the edges 134, 136 can be separated by a continuous gap, and in other embodiments, the edges 134, 136 can at least partially contact each other. In still further embodiments, described below with reference to FIGS. 2C-2D, the discontinuity can include a series of gaps. In any of these embodiments, without being bound by theory, it is believed that a first nodal band can form generally along the discontinuity at the separation portion 138. The body portion 106 can produce a fundamental pitch based on the first nodal band and a second nodal band located 180° around the circumference, i.e., directly across from the separation portion 138. It is also believed that the body portion 106 can resonate circumferentially with additional resonating nodes (not shown) between the fundamental nodal bands to produce sounds with different pitches. For example, possible nodal bands can be located at 45°, 90°, 135°, and 270° around the circumference of the body portion 106.

The body portion 106 can be constructed from any material that has sufficient strength and flexibility. For example, suitable materials can include a metal, a metal alloy, a laminated metal sheet, plastic, wood, plywood, and/or fiberglass. In one embodiment, the body portion 106 can be constructed from a single layer of material. For example, the body portion 106 can be constructed by rolling a stainless steel sheet into a generally cylindrical shape. In other embodiments, the body portion can be constructed from a laminated sheet with multiple layers, at least two of which are metal layers, as described in more detail below with reference to FIGS. 4A-4B.

A snare 120 can be positioned adjacent to the first or second portion 102*a-b* to provide additional sound texture. The snare 120 typically includes terminus plates 121*a-b* and a plurality of strings 123 attached to the terminus plates 121*a-b*. The strings 123 can be straight or curled and can be constructed from any suitable materials, such as metals and metal alloys. The snare 120 is typically tensioned with an external tensioning device (not shown) attached to the body portion 106. Further details of appropriate snares 120 are disclosed in pending U.S. application Ser. No. 11/333,894, titled "Snare Drum Assemblies, Including Assemblies with Flexible Snare Anchors, and Associated Methods, filed concurrently herewith and incorporated herein by reference.

In operation, a user can strike the first membrane 122*a* of the first portion 102*a* causing the first membrane 122*a* to vibrate. The vibration of the first membrane 122*a* can cause the air pressure inside the body portion 106 to pulsate with a corresponding frequency. The pulsating air can cause the body portion 106 to resonate circumferentially between the nodal bands because of the circumferential flexibility of the body portion 106. The pulsating air can also cause the second membrane 122*b* on the second portion 102*b* to vibrate at its own resonance frequencies. The vibrations of the second membrane 122*b* can excite the optional snare 120 adjacent to the second portion to produce a short, distinctive, snap-like sound.

One expected advantage associated with at least some embodiments of the drum 100 is an improved sound quality. Existing resonating devices (e.g., drums, guitars, and speakers) typically have a solid body with resonating elements (e.g., membranes, strings, and diaphragms) placed adjacent to the body cavity. During operation, the sound of the resonating devices is mainly produced from vibrations of the resonating elements. The body of the device can only produce a muffled sound because of the destructive interference of the sound waves carried by the body. By providing a discontinuity in the body portion 106, the body portion 106 can circumferentially resonate, independently from the resonating elements (e.g., membranes 122*a-b*). As a result, the resonating device can produce, transmit, or enhance a wider range of sound due to the resonating vibrations of both the resonating elements and the body portion 106.

Another expected advantage associated with at least some embodiments of the drum 100 is an enhanced tuning range. As described above, the first and second couplers 108*a-b* can have a plurality of attachment elements 132*a-b* that can be either rigidly or flexibly attached to the body portion 106. When the attachment elements 132*a-b* are rigidly attached, they can cause the body portion 106 to have additional harmonic nodal bands around its circumference. As a result, different vibrating frequencies of the body portion 106 can be achieved by modifying the number and/or the locations of the attachment elements 132. For example, the two oppositely facing attachment points 132*a-b* can be replaced by three, four, or more points, placed symmetrically or asymmetrically. Accordingly, different vibrating frequencies of the body portion 106 can be achieved by appropriately selecting the attachment locations on the body portion 106 and the attachment mechanisms. In further embodiments, the vibrating frequencies of the body portion 106 can be selected by rigidly attaching the body portion 106 to external components (not shown, e.g., a drum stand) at various selected attachment locations of the body portion 106.

Figure 1B:
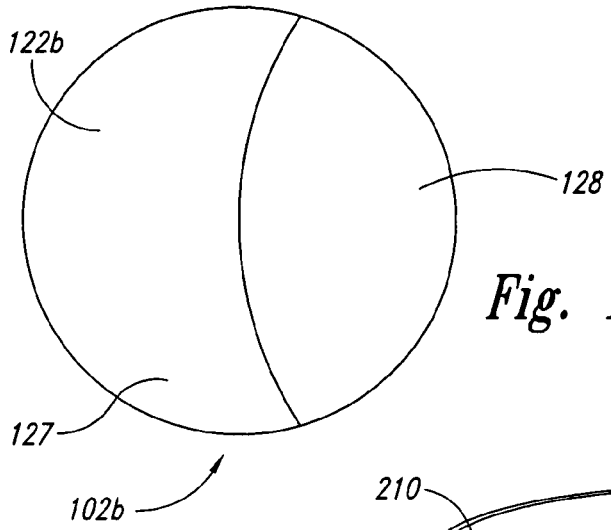
FIG. 1B is a bottom view of a portion of the resonating device of FIG. 1A and configured in accordance with an embodiment of the invention.

The body portion 106, the first and second portions 102*a-b*, and the first and second couplers 108*a-b* can have many additional embodiments with different and/or additional features without detracting from the operation of these elements. For example, in certain embodiments, the first portion 102*a* and/or the second portion 102*b* can be partially open as shown in FIG. 1B. The second portion 102*b* can have an enclosed portion 127 constructed from the membrane 122*b* and an open portion 128. The opening 128 can have any user-desired shape. One expected advantage of having a partially open portion is that dramatically different sounds can be produced by varying the shape of the opening.

In other embodiments, the second portion 102*b* may or may not have a membrane constructed from the same material as that of the first portion 102*a*. The second portion 102*b* and the second coupler 108*b* can be constructed from a material that is different than that of the first portion 102*a* and the first coupler 108*a*. The second coupler 108*b* may or may not have the attachment elements 133*b*. In addition, the body portion 106 can have a non-cylindrical shape. For example, the body portion 106 can be conical, rectangular, spherical, or any combination of these shapes. Furthermore, the drum rims 124*a-b* and the first and second couplers 108*a-b* can be coupled together by one set of tensioning devices such that the tension applied to both membranes 122*a-b* can be varied concurrently.

Figure 2A:
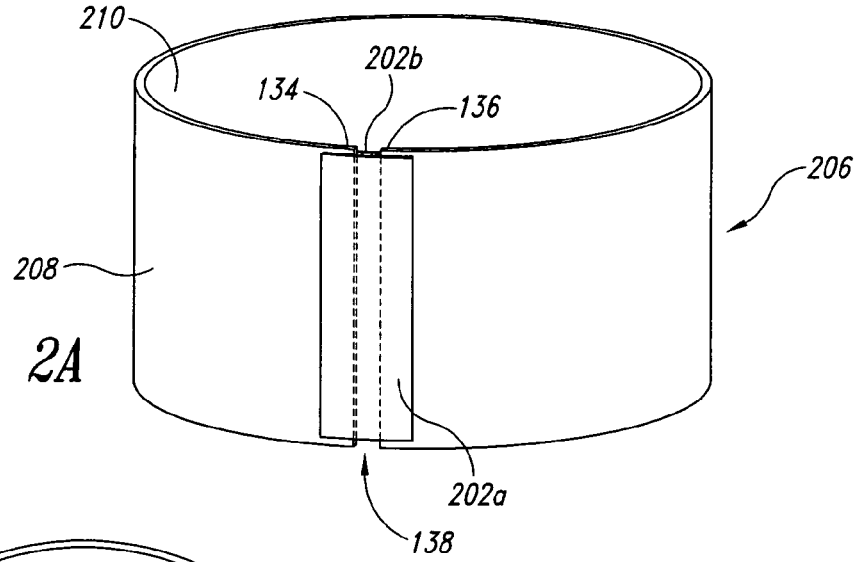
FIG. 2A is an isometric view and FIG. 2B is a top view of a portion of a resonating device configured in accordance with an embodiment of the invention.
Figure 2B:
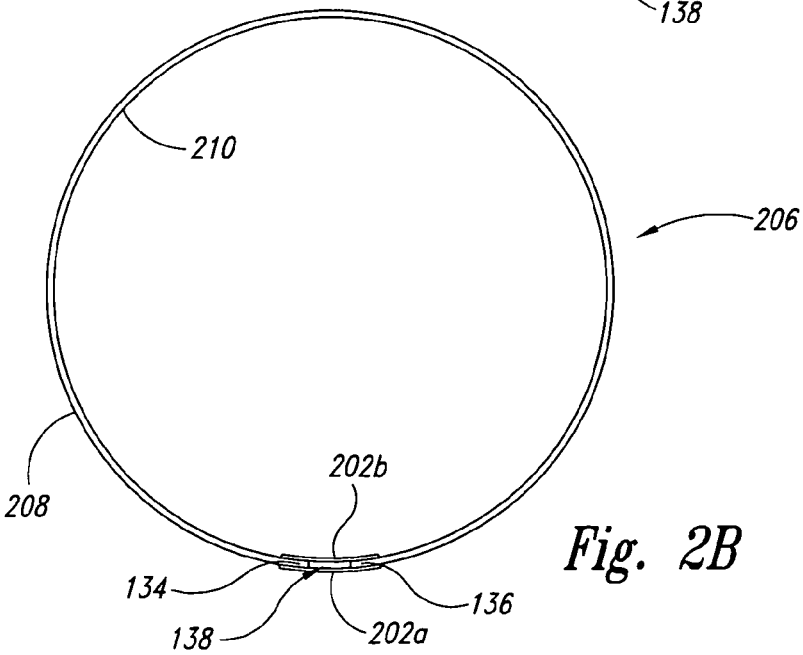

FIG. 2A is an isometric view and FIG. 2B is a top view of a body portion 206 configured in accordance with another embodiment. In one aspect of this embodiment, the body portion 206 can include at least one fastener that flexibly couples the two edges 134, 136 of the body portion 206. In the embodiment shown in FIG. 2A, a first flexible tape portion 202*a* is attached to the body portion 206 across the separation portion 138 on an outer surface 208 of the body portion 206. A second flexible tape portion 202*b* is attached to the body portion 206 across the separation portion 138 on an inner surface 210 of the body portion 206. The flexible tape portions 202*a-b* can include at least one of a metal tape, a cloth tape, a plastic tape, or any other material with sufficient strength and flexibility. The first and second flexible tape portions 202*a-b* can be attached to the body portion 206 using adhesives, bolts, screws, buckles, clamps, clips, buttons, rivets, or any other suitable attachment mechanism. In some embodiments, the body portion 206 can have a pre-formed shape and does not rely on the tape portions 202*a-b* to hold its shape. In other embodiments, the body portion 206 can be made from metal sheets that rely on the tape portions 202*a-b* (or other flexible fasteners) to hold its shape. In any of these embodiments, the flexible tape portions (and the gap itself) at the discontinuity are representative examples of discontinuities having a stiffness less than the stiffness of the body portion 206.

In operation, it is believed that the flexible tape portions 202*a-b* can isolate vibrations between the edges 134, 136 across the separation portion 138. When the body portion 206 is excited, circumferential vibrations propagate along the circumference of the body portion 206 between the two edges 134, 136. The flexible tape portions 202*a-b* interrupt the propagation across the separation portion 138 because the flexible tape portions can have different resonance frequencies than those of the body portion 206. As a result, the body portion 206 can avoid destructive interference of the sound waves and can resonate circumferentially.

One expected advantage of an embodiment of the body portion 206 having flexible tape portions 202*a-b* is that the flexible tape portions 202*a-b* can maintain the shape of the body portion 206 for ease of manufacturing and assembly. For example, the body portion 206 can be manufactured as a sub-assembly before the drum 100 is completely assembled. Another expected advantage is that by using different types of flexible tape portions, the manufacturer can control the sound produced by the drum 100. For example, using cloth tape would likely result in a lower pitched sound than using metal tape.

The first and second flexible tape portions 202*a-b* can have many additional embodiments with different and/or additional features without detracting from the operation of these elements. For example, the second flexible tape portion 202*b* may be omitted, or may be constructed from a different material than the first tape portion 202*a*. The first and second flexible tape portions 202*a-b* may be attached to the body portion 206 using the same or different attachment mechanisms.

Figure 2C:
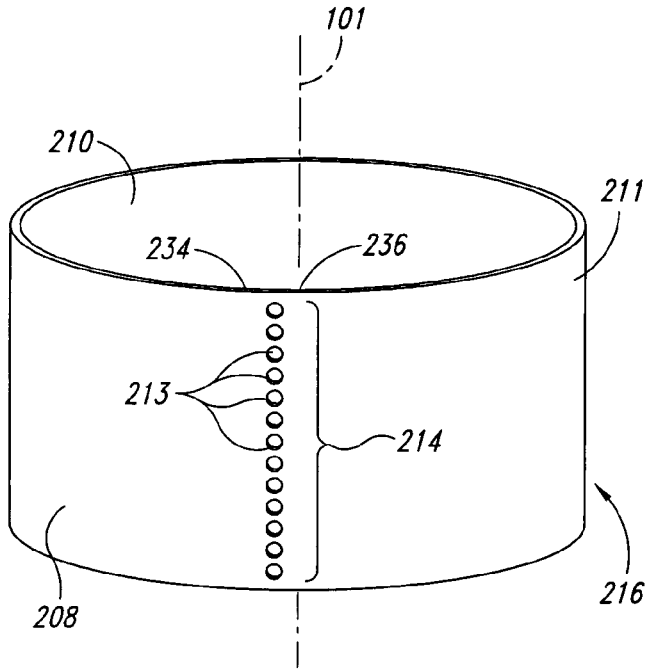
FIG. 2C is an isometric view and FIG. 2D is a top view of a portion of a resonating device configured in accordance with another embodiment of the invention.
Figure 2D:
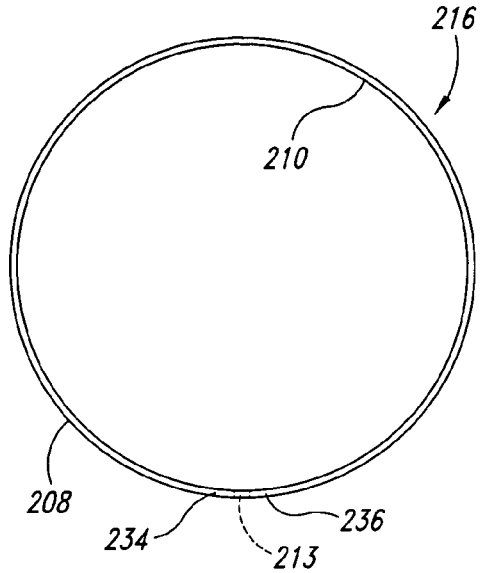

FIG. 2C is an isometric view and FIG. 2D is a top view of a body portion 216 configured in accordance with another embodiment of the invention. In one aspect of this embodiment, the body portion 216 can include a plurality of perforations 213 positioned along an axis generally aligned with the cylindrical axis 101 of the body portion 216. In the example shown in FIG. 2C, the body portion 216 can include a solid portion 211 having end portions 234, 236 that are separated by a separation portion 214. The separation portion 214 can include a plurality of apertures or perforations drilled at least partially into (and in at least some cases, entirely through) the body portion 216. The pitch between each perforation 213 can be adjusted to any desired dimension.

In operation, the perforations 213 can provide a discontinuity that can isolate vibrations between the end portions 234 and 236 of the body portion 216. During use, circumferential vibrations propagate along the circumference of the solid portion 211 between the two end portions 234 and 236. The perforations 213 can interrupt the propagation across the separation portion 214 because the vibrations propagate differently through the solid portion 211 than the separation portion 214.

Having a body portion 216 with perforations can be advantageous for ease of manufacturing. For example, the body portion 216 can be manufactured from solid bodies instead of sheets of materials by drilling a plurality of holes on or through the body portion 216. Another expected advantage is that the manufacturer can select the type of sound produced by the resonating devices by selecting the types of holes or perforations placed on the body portion 216. For example, perforations having different cross sectional areas are expected to result in different vibrational behaviors of the body portion 216 and can be selected accordingly.

The perforations 213 can have many additional and/or different features in other embodiments. For example, the perforations 213 can include a plurality of axially aligned slots instead of circular holes. Each of the slots can have equal or unequal lengths. In certain embodiments, the perforations 213 can be arranged in multiple columns generally parallel to each other instead of a single column. In certain embodiments, the slots or other perforations can penetrate completely or only partially through the body portion 216.

Figure 2E:
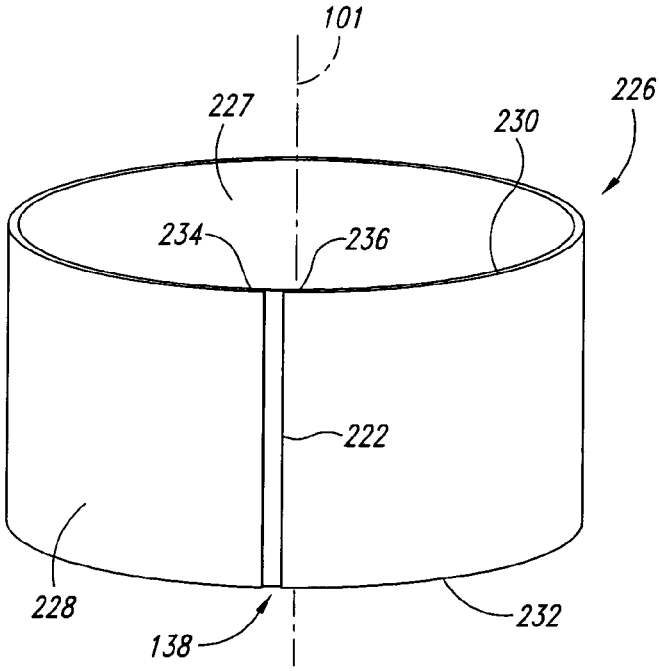
FIG. 2E is an isometric view and FIG. 2F is a top view of a portion of a resonating device configured in accordance with another embodiment of the invention.
Figure 2F:
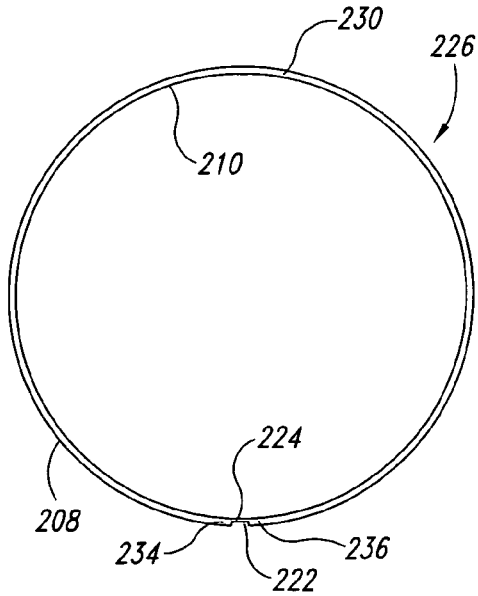

FIG. 2E is an isometric view and FIG. 2F is a top view of a body portion 226 configured in accordance with another embodiment of the invention. The body portion 226 can include at least one axially extending slit or channel 222 separating the end portions 234, 236. The slit or channel 222 can be located on an inside surface 227, an outside surface 228, or both. In the example shown in FIG. 2E, the axial slit 222 is located on the outside surface 228 of the body portion 226. The slit 222 can extend axially from the top surface 230 to the bottom surface 232 of the body portion 226 and can have a generally uniform width. As shown in FIG. 2F, the slit 222 only partially penetrates the side wall of the body portion 226 to create a separation portion 224 with a reduced wall thickness.

In operation, the slit 222 can isolate vibrations between the end portions 234, 236 of the body portion 226. For example, the slit 222 can interrupt the circumferential vibration propagation at the separation portion 224 due to the reduced thickness of the wall. Generally, metal sheets with different thicknesses vibrate with different characteristics when excited. As a result, the slit 222 can cause the separation portion 224 to have different resonance characteristics than the rest of the body portion 226 and can therefore form a discontinuity between the end portions 234, 236.

In at least some embodiments, the slit 222 can be easily manufactured by machining an initially solid body portion 226. For example, simply milling an outside surface of a metal tube can produce the body portion 226 efficiently. Another expected advantage of this arrangement is that the characteristics of the body portion 226 can be selected and/or controlled by selecting different configurations for the slit or channel. For example, varying the penetration depth of the slit 222, or changing the cross-sectional area of the slit can affect the sound produced by the body portion 226.

C. Resonating Device with Circumferential Openings

Figure 3A:
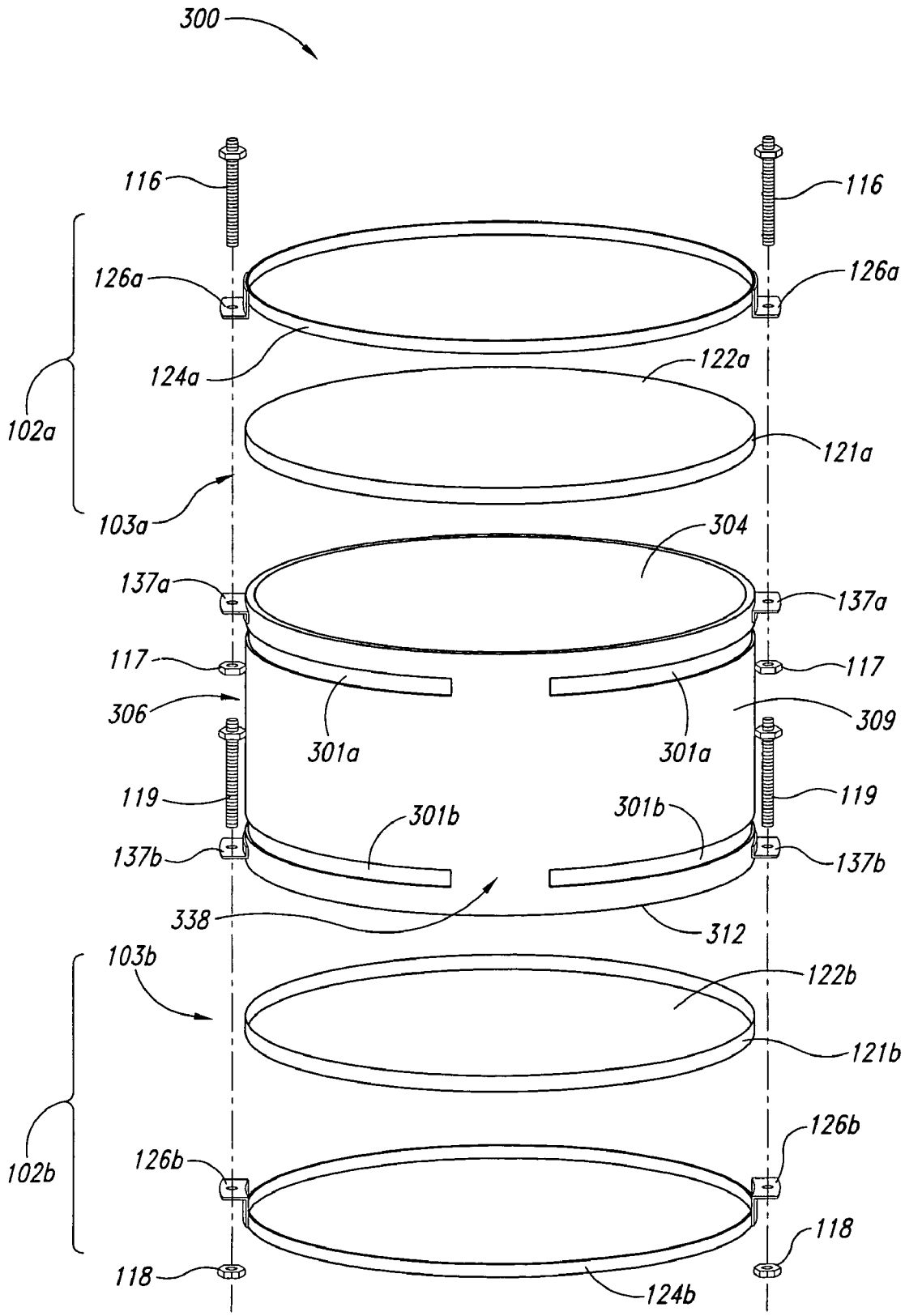
FIGS. 3A-D are isometric views of resonating devices configured in accordance with still further embodiments of the invention.

FIG. 3A is an isometric view of a resonating device in the form of a drum 300 configured in accordance with another embodiment of the invention. In this example, several components of the drum 300 are similar to the components of the drum 100 described above. As such, like reference symbols generally refer to like features and components in FIGS. 1A-2E. The drum 300 can include a first portion 102*a* with a first membrane 122*a*, a second portion 102*b* with a second membrane 122*b*, and a body portion 306 with a first end 304, a second end 312, and a surface 309 between the first end 304 and the second end 312 to enclose a resonating chamber volume. The surface 309 of the body portion 306 can further include a circumferential opening extending partially around a circumference of the surface 309.

The first portion 102*a* can be configured similarly to the first portion 102*a* shown in FIG. 1A, except that the drum head 103*a* can be fastened directly onto the first end 304 of the body portion 306. In one embodiment, the body portion 306 can include attachment members 137*a-b* (e.g., lugs) located on the surface 309 for accommodating the tensioning devices 117, 119. The drum rim 124*a* can be positioned adjacent to the drum head 103*a* and coupled to the body portion 306 with tensioning devices 116, 117 extending through the attachment members 126*a* and 137*a*. As such, the drum head 103*a* can be clamped between the drum rim 124*a* and the opening end of the body portion 306. By tightening the tensioning devices 116 and 117, the tension applied to the membrane 122*a* can be adjusted.

The body portion 306 can be configured to isolate vibrations emanating from the membranes 122*a-b* from each other, and from vibrations emanating from the body portion 306 itself. In one embodiment, the surface 309 can include a first circumferential opening 301*a* proximate to the first end 304 and a second circumferential opening 301*b* proximate to the second end 312 of the body portion 306. The openings 301*a-b* can be generally parallel to each other and can extend around the circumference of the body portion 306 with a generally uniform width. The openings 301*a-b* can be circumferential slots or channels with any desired width. The circumferential openings 306*a-b* can isolate vibrations emanated at each of the opposing membranes 122*a-b* from the body portion 306. The body portion 306 can include a discontinuity 338 (e.g., a joint or other separation portion) that allows the body portion 306 to resonate in a manner generally similar to that described above with reference to FIG. 1A. The openings 301*a-b* can be offset from the discontinuity 338 to allow for sufficient structural support to the body portion 306.

The circumferential openings 301*a-b* can allow the body section 306 to flexibly vibrate and generate sound independent of the vibrations from the first and second portions 102*a-b*. When the first portion 102*a* is excited, vibration propagation from the first portion is stopped or at least inhibited by the openings 301*a-b* before reaching the central region of the body portion 306. As such, each of the membranes 122*a-b* and the central portion of the body portion 306 can flexibly resonate to generate sound independently from each other. Accordingly, in at least one embodiment, the opening 301*a-b* can perform the same function as the couplers 108*a-b* as described above with reference to FIG. 1A. In at least some cases, the openings 301*a-b* may be easier to manufacture and install then the couplers 108*a-b*. On the other hand, the couplers 108*a-b* can perform additional functions, including providing tuning on pitch control for the drum 300. An embodiment that containing these features is described below with reference to FIG. 3C.

Figure 3B:
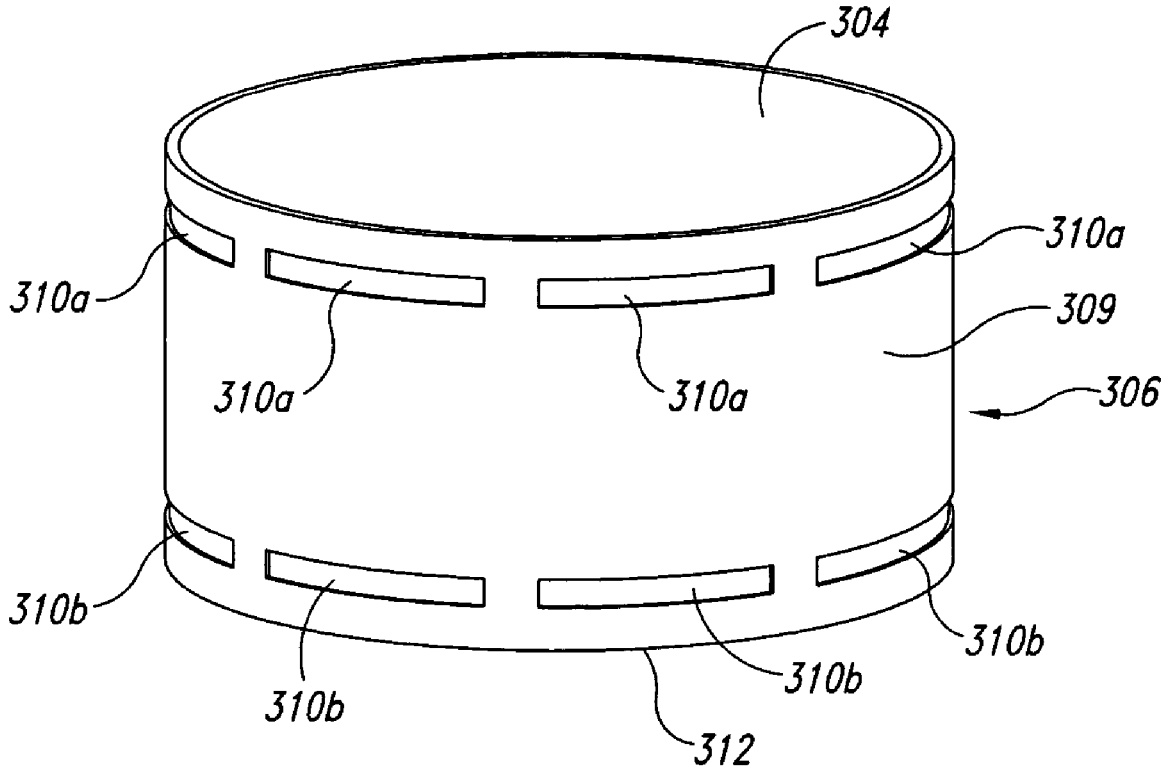

In another embodiment shown in FIG. 3B, the surface 309 can include a plurality of circumferential openings arranged in sets, e.g., two sets of circumferential openings 310*a* and 310*b*. The two sets are generally parallel to each other. In another aspect, each set of openings 310*a-b* can be divided into multiple sections. Each section of the openings can have equal lengths and can be generally symmetrical around the circumference of the body portion 306. In other embodiments, the body portion 306 can include sets of openings with a different number of sections. In any of these embodiments, the openings of one set can be generally aligned with the openings of the other sets, as shown in FIG. 3B.

Figure 3C:
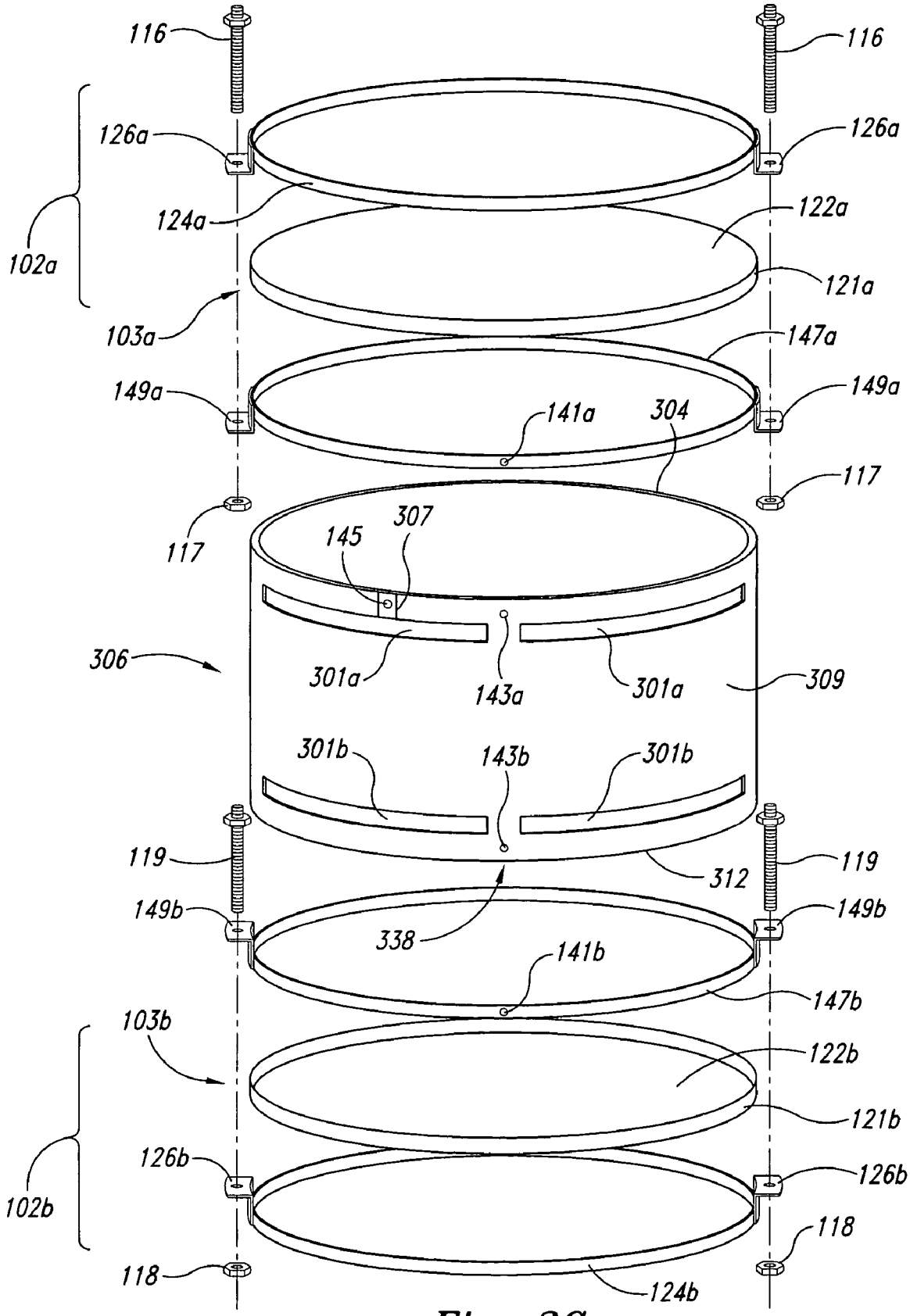

FIG. 3C illustrates another embodiment of the drum 300 having a coupling rim 147*a* between the drum rim 126*a* and the body portion 306. In this embodiment, the coupling rim 147*a* can be either flexibly or fixedly attached to the outside surface 309 of the body portion 306 with fasteners extending through attachment elements 141*a* (e.g., apertures) of the coupling rim 147*a* and corresponding attachment elements 143 (e.g., apertures) of the body portion 306. For example, the coupling rim 147*a* can be flexibly attached to the body portion 306 with a vibration isolator (described in greater detail below with respect to FIGS. 4A-B). The coupling rim 147*a* can further include attachment members 149*a* (e.g., brackets) that correspond to the attachment members 126*a* of the drum rim 124*a*. The drum rim 124*a* can be positioned adjacent to the drum head 103*a* and coupled to the coupling rim 147*a* with tensioning devices 116, 117 extending through the attachment members 126*a* and 149*a*.

By selecting the appropriate attachment locations between the coupling rim 147*a* and the body portion 306, a manufacturer and/or user can tune the pitch produced by the body portion 306. For example, the body portion 306 can have additional nodal bands by fixedly attaching the coupling rim 147*a* to the body portion 306 at selected locations (e.g., location 145) around the circumference of the body portion 306. Once the coupling rim 147*a* is fixedly attached at the location 145, it is believed that the end region 307 of the body portion 306 that includes the fixed location 145 can modify the pitch of the body portion 306. As a result, the pitch produced by the body portion 306 can be modified. Multiple fixed locations can be used to achieve a wider variety of sounds. In further embodiments, the pitch of the body portion 306 can be modified by rigidly attaching the body portion 306 to external components (not shown, e.g., a drum stand) at various selected locations of the body portion 306.

Figure 3D:
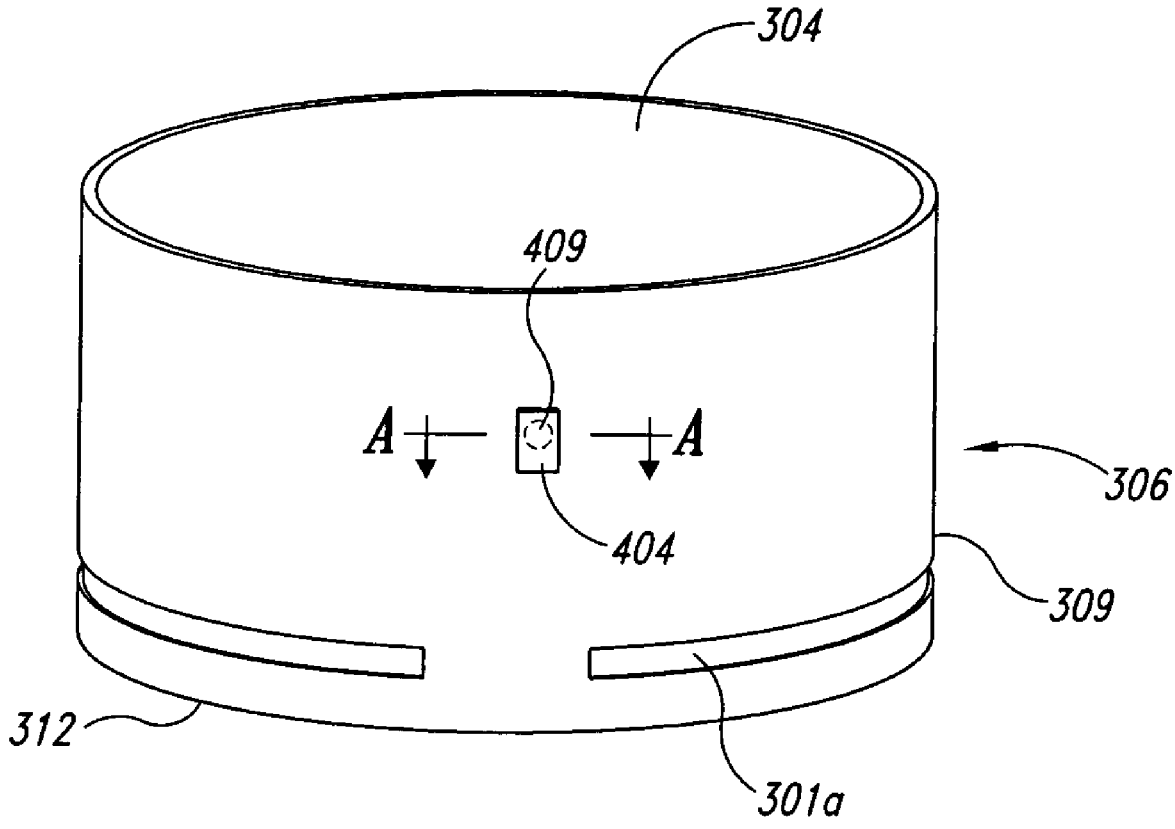

FIG. 3D illustrates another embodiment of the drum 300 having a single circumferential opening at a location between the first end 304 and the second end 312. In this embodiment, the single circumferential opening can separate the vibrations of the first end 102*a* from the vibrations of the second end 102*b*. As a result, cross interference of vibrations between the first and second membranes 122*a-b* can be reduced or eliminated. In addition, the body portion 306 can include a bracket 404 attached to the body portion 306 with a vibration isolator 409, as described in more detail below with respect to FIGS. 4A-B.

D. Resonating Device with Vibration Isolators

Figure 4A:
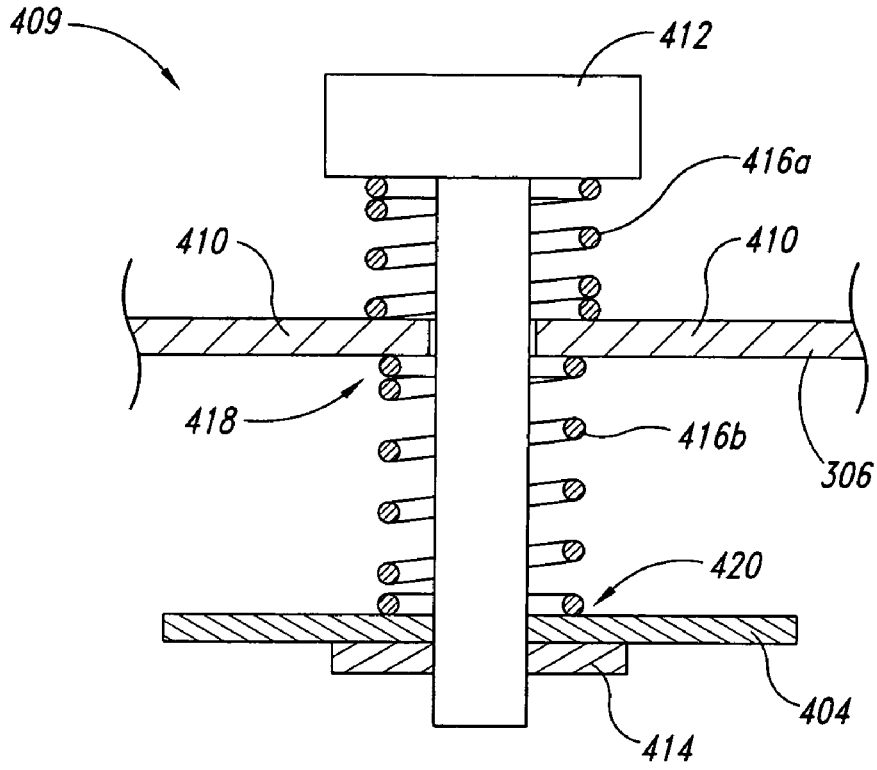
FIGS. 4A-B are cross-sectional views of portions of resonating devices configured in accordance with other embodiments of the invention.
Figure 4B:
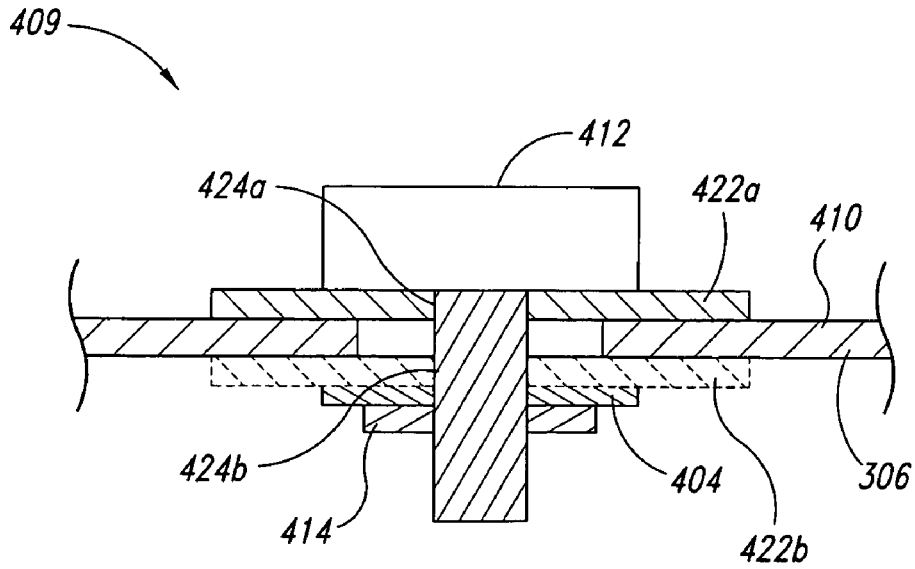

FIG. 4A is a cross-sectional view of an embodiment of the vibration isolator 409 shown in FIG. 3D. In one aspect of this embodiment, the vibration isolator 409 can include a plurality of vibration isolation elements, e.g., first and second springs 416*a-b* positioned between the bracket 404 and the body portion 306. The body portion 306 includes a wall 410 with a first aperture 418, and the bracket 404 includes a second aperture 420 aligned with the first aperture 418. The first spring 416*a* urges a bolt 412 away from the wall 410 of the body portion 306, and the second spring 416*b* urges the bracket 404 and a nut 414 (attached to the bolt 412) away from the wall 410. Accordingly, the bracket 404 and the body portion 306 can move (at least slightly) relative to each other in a direction generally perpendicular to the wall 410. As a result, the bracket 404 and any external component attached to the bracket 404 are flexibly attached to the wall 410 such that these components can vibrate independently.

In another embodiment, the vibration isolation elements can include a plurality of flexible tape portions 422*a-b*. In an embodiment shown in FIG. 4B, a flexible tape portion 422*a* is attached to the outer surface of the wall 410. The flexible tape portion 422*a* can include apertures 424*a* that align with the first and second apertures 418 and 420. The bracket 404 can then be flexibly attached to the wall 410 with the bolt 412 extending through the apertures 418, 420, 424*a* to engage the nut 414. The vibration isolator 409 can optionally include another flexible tape portion 422*b* attached to the inner surface of the wall 410. The flexible tape portions 422*a-b* can include at least one of a metal tape, a cloth tape, a plastic tape, or any other material with sufficient flexibility. The first and second flexible tape portions 422*a-b* can be attached to the inner and outer surfaces of the wall 410 using an adhesive. In other embodiments, the tape portions can be replaced with any flexible sheet or membrane attached to the wall 410 with bolts, screws, buckles, clamps, clips, buttons, rivets, or any other suitable attachment mechanism. The flexibility of the tape portions 422*a-b* (or other sheet or membrane) can allow slight movement of the bracket 404 relative to the wall 410 during use. In other embodiments, one flexible tape portion can be attached to either the inside surface or the outside surface of the wall 410 for providing the slight relative movement between the bracket 404 and the wall 410.

One expected advantage of embodiments of the vibration isolator 409 is that the body portion 306 can be isolated from external vibration interferences for improved sound. When the body portion 306 vibrates due to resonance, the interference of external vibration is at least reduced because the springs, flexible tape portions or other vibration isolation elements can at least partially absorb the external vibration. As a result, the body portion 306 can produce a more "pure" sound.

E. Resonating Device with Laminated Metal Layers

Figure 5A:
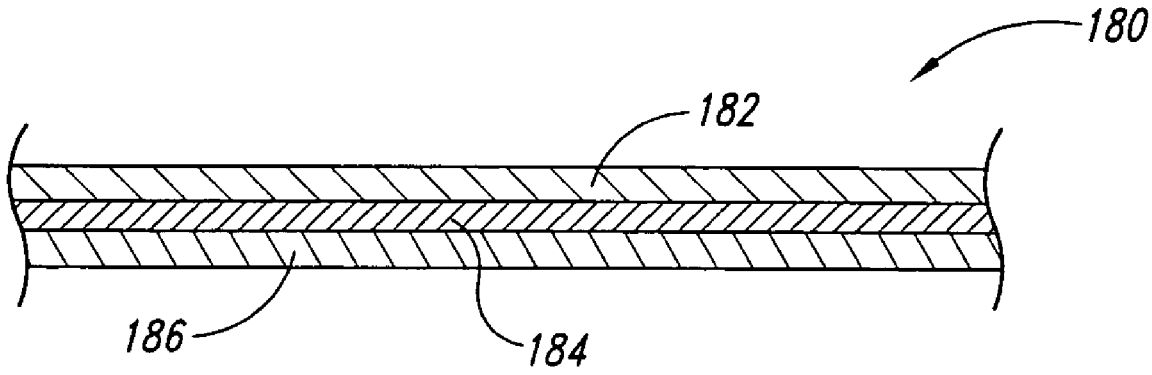
FIGS. 5A-B are cross-sectional views of portions of the resonating devices configured in accordance with yet further embodiments of the invention.

In any of the embodiments described above with reference to FIGS. 1A-4B, the body portion can be constructed from a sheet with laminated layers, at least two of which are metal layers. FIG. 5A illustrates an embodiment of a laminated sheet 180 with three layers, e.g., first, second, and third layers 182, 184, and 186, at least two of which are metal layers.

In one aspect of this embodiment, each layer can include at least one of steel, aluminum, copper, zinc, magnesium, lead, gold, silver, titanium, brass, bronze, nickel, chromium, platinum, and palladium. The metal layers include pre-formed structures that are bonded together, e.g., in a cold press, or with interlayer adhesives. Each of the layers 182, 184, and 186 can include a metal layer with a thickness of not less than 0.001 inches. For example, the sheet 180 can include a laminated metal sheet that has a layer of aluminum having a thickness of 0.060 inches (e.g., the second layer 184) sandwiched between two layers of stainless steel (e.g., the first and third layers 182, 186), each having a thickness of 0.003 inches. All three layers can be cold pressed to form the sheet 180. In another aspect, the metal sheet 180 can be constructed with a layer (e.g., the second layer 184) having a low hardness (e.g., aluminum) sandwiched between two layers (e.g., the first and third layers 182, 186) having a relatively high hardness (e.g., stainless steel). In a further aspect, the metal sheet 180 can include at least one layer of non-metallic material, such as wood, plastic, fiberglass, and rubber.

Figure 5B:
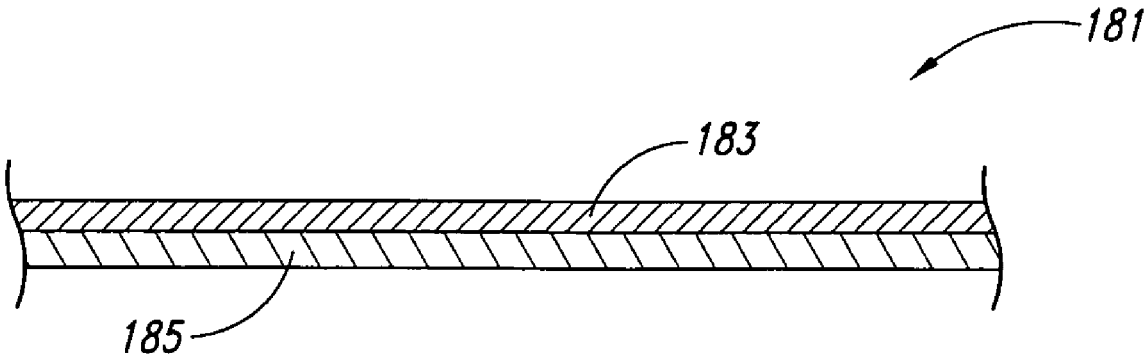

FIG. 5B illustrates another embodiment of a laminated sheet 181 with two metal layers 183 and 185. Each of the layers 183,185 can include a pre-formed metal layer with a thickness of not less than 0.001 inches. The two metal layers 183 and 185 can be similar metal layers or can be dissimilar metal layers. For example, the sheet 181 can be a laminated sheet having two stainless steel layers bonded together, or can be a layer of stainless steel bonded to a layer of copper.

One expected advantage of having a laminated sheet 180 is that it can increase the variety of sounds produced by the body portion 106 (FIG. 1A). Generally, bodies with different materials can produce different sounds when resonating. However, some metals, such as aluminum and copper, lack the mechanical strength to be used alone as a thin sheet for constructing the body portion 106. Laminating the soft metals with higher strength metals or metal alloys, such as stainless steel, can produce bodies capable of making new sounds.

From the foregoing, it will be appreciated that specific embodiments of the invention have been described herein for purposes of illustration, but that various modifications may be made without deviating from the spirit and scope of the invention. For example, the resonating devices may have shapes, dimensions, and/or arrangements different than those shown in FIGS. 1A-5B. The resonating device can include, for example, speakers, or musical instruments other than drums (e.g., guitars). Various embodiments described may be combined. In addition, the transmission of electrically produced sound (e.g., by an electric speaker) can be enhanced using various embodiments of the present invention. The device may include features in addition to and/or other than those shown in the Figures. Although advantages associated with certain embodiments of the invention have been described in the context of those embodiments, other embodiments may also exhibit such advantages. Additionally, none of the foregoing embodiments need necessarily exhibit such advantages to fall within the scope of the invention. Accordingly, the invention is not limited except as by the appended claims.

I claim:

1. A drum for producing sound, comprising:

a generally planar first portion having a membrane;

a generally planar second portion opposite and generally parallel to the first portion; and a generally cylindrical body portion between the first portion and the second portion, the body portion generally having a first circumferential extent with a first stiffness, the body portion further having a discontinuity with a second stiffness less than the first stiffness, the discontinuity having a second circumferential extent less than the first and being positioned to allow the body portion to circumferentially vibrate relative to the discontinuity.

2. The drum of claim 1 wherein the body portion is arranged about an axis extending between the first and second portions, and wherein the body portion includes a separation portion generally parallel to the axis, and wherein the discontinuity is located at and aligned along the separation portion.

3. The drum of claim 2 wherein the body portion includes two edges, and wherein the separation portion includes a gap between the two edges of the body portion.

4. The drum of claim 2 wherein the separation portion includes a slit, a plurality of perforations, or a channel located on the body portion and arranged generally parallel to the axis.

5. The drum of claim 1 wherein the body portion is constructed from a material that includes at least one of a metal, a metal alloy, a laminated metal sheet, plastic, wood, plywood, and fiberglass.

6. The drum of claim 1 wherein the second portion includes another membrane, and wherein the drum further comprises a snare adjacent to the membrane of the second portion.

7. The drum of claim 1, further comprising a coupler between the first portion and the body portion, the coupler being attached to the body portion and having an edge bearing against the membrane of the first portion, the coupler being positioned to allow the membrane to vibrate relative to the body portion.

8. The drum of claim 1, further comprising a plurality of tensioning devices connected between the first portion and the second portion and positioned to apply an axial compressing force on the membrane.

9. The drum of claim 1, further comprising:

a coupler between the membrane and the body portion, the coupler being attached via at least one vibration isolation element to the body portion and having an edge bearing against the membrane, wherein the coupler is positioned to allow the membrane to vibrate relative to the body portion.

10. The drum assembly of claim 9 wherein the coupler includes a plurality of attachment elements spaced apart from each other, the plurality of attachment elements being attached to a plurality of corresponding locations toward a first end of the body portion.

11. The drum assembly of claim 9 wherein the coupler is releasably attached to the plurality of corresponding locations on the body portion.

* * * * *